United States Patent [19]

Johnson

[11] 4,093,172

[45] June 6, 1978

[54] TOOL FOR BRICKLAYING

[76] Inventor: Kenneth Frank Johnson, 22 Station Road, Deagon. Q. 4017, Australia

[21] Appl. No.: 786,890

[22] Filed: Apr. 12, 1977

[51] Int. Cl.[2] ..... E04G 9/00

[52] U.S. Cl. ..... 249/19; 249/83; 249/188; 425/458

[58] Field of Search ..... 425/87, 458; 249/83, 249/117, 187, 188; 401/9

[56] References Cited

U.S. PATENT DOCUMENTS

| | | | |
|---|---|---|---|
| 889,943 | 6/1908 | Maddux | 425/87 |
| 2,400,852 | 5/1946 | Stevenson | 249/194 |
| 2,462,644 | 2/1949 | Kimura | 425/218 |
| 2,824,443 | 2/1958 | Ames | 401/9 |

*Primary Examiner*—Francis S. Husar
*Assistant Examiner*—John McQuade
*Attorney, Agent, or Firm*—D. Paul Weaver

[57] ABSTRACT

A hand-tool for mortaring bricks in a course includes a frame bent transversely at right angles, the side pieces of said frame carrying flanges to align the tool by engaging the side faces of bricks already laid. A handle is attached to the frame.

9 Claims, 2 Drawing Figures

TOOL FOR BRICKLAYING

BACKGROUND OF THE INVENTION

THIS INVENTION relates to a tool for use when laying bricks or blocks (hereinafter included in the term "bricks") in a building structure.

Both the correct positioning of and the amount of mortar used between bricks, and the correct alignment and levelling of bricks in the structure are a matter of considerable skill, so that effective construction is slow and difficult for unskilled operators.

SUMMARY OF THE INVENTION

An object of this invention is to enable even unskilled people to lay bricks effectively and quickly. This is accomplished by a hand-tool which essentially controls the spread and amount of mortar applied to joints between bricks, and acts as a check on the alignment of a new brick with those already laid.

Accordingly the invention comprises a hand tool to aid in laying courses of similar bricks, said tool including: a frame having a first part and a second part bent at right angles to said first part about a line transverse to said frame; each said part having side pieces and a transverse end piece; a flange depending from each side piece to engage the side faces of at least one brick in an existing course of bricks; and a handle attached to one said part.

SHORT DESCRIPTION OF THE DRAWINGS

In order that the invention may be better understood, a particular example of it will be described with reference to the accompanying drawings, in which.

DETAILED DESCRIPTION OF THE PREFERRED EMBODIMENT

Figure 2:
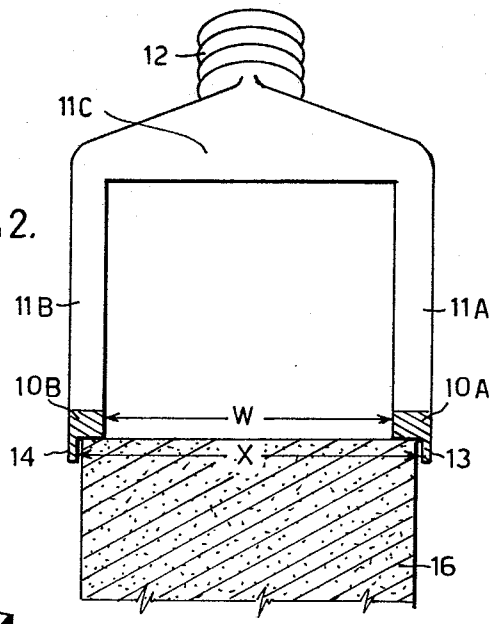
FIG. 2 is a section on line 2—2 of FIG. 1.

The tool consists of a L-frame preferably cast in aluminium or plastic having a part 10 which in the working position (as shown) is horizontal, and a part 11 bent at right angles to a vertical position.

Part 10 has side-pieces 10A, 10B and a transverse end piece 10C, while part 11 has side pieces 11A, 11B and an upper end piece 11C to which a handle 12 is attached. Side pieces 10A, 11A and 10B, 11B having a depending flange 13, 14 respectively attached to them.

The width W between corresponding side pieces is made slightly less than the width of bricks 15, 16, 17 being used, while the spacing X between flanges 13 and 14 is made slightly greater. Flanges 13, 14 can therefore engage the side faces of bricks 16 and 17 and (as shown) a small length of the side faces of brick 15.

Side pieces 10A, 10B and end piece 10C lie on the upper face of bricks 15, 16 and side pieces 11A, 11B and end piece 11C against the end face of brick 17.

Parts 10 and 11 are dimensioned so that they form a shallow frame around these surfaces, the internal length of part 10 being preferably slightly more than the length of a brick and the internal height of part 11 being substantially the height of a brick.

In using the tool the base course of bricks such as 15. 16 may be laid in the usual way by string line.

Figure 1:
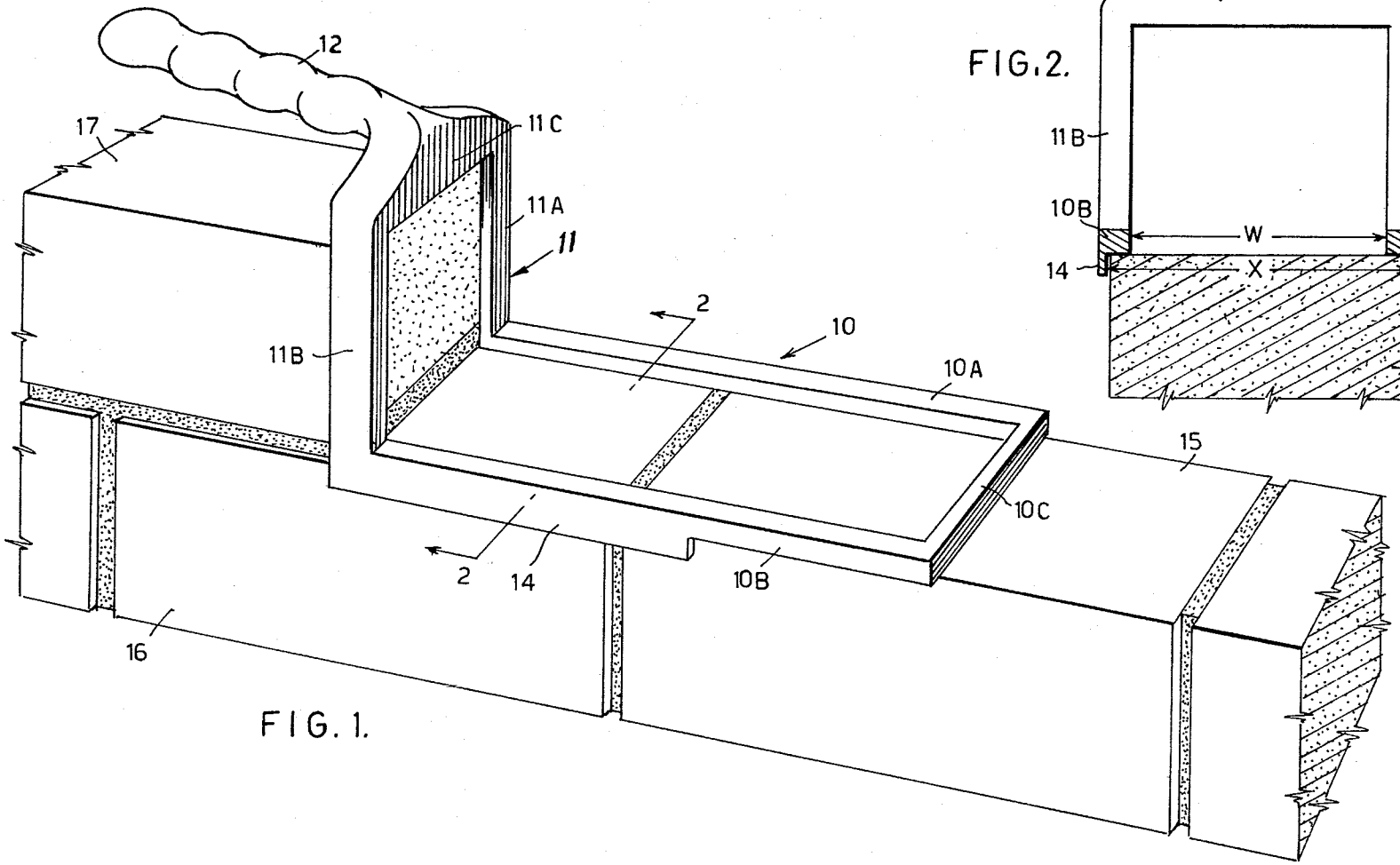
FIG. 1 is an isometric view of the tool in working position.

An end brick 17 of the next course may be laid by placing the tool with part 10 on the base course centred by flanges 13, 14 and smoothing mortar with a trowel to fill the "frame" of part 10. The tool is then removed and the brick placed. Thereafter the tool is placed as shown in FIG. 1, mortar is applied and smoothed to fill the frames of parts 10 and 11, the tool removed and brick placed, and so on for the whole course.

Flanges 13, 14 engage the side faces of several adjacent bricks already laid and the tool cannot seat properly unless these bricks are aligned, so a constant check of alignment occurs. The level of mortar is controlled and this enables accurate positioning of bricks being laid. Furthermore, the side and end pieces prevent mortar spilling beyond the edges of the bricks and avoid the necessity of cleaning and pointing the wall.

While the inner faces of side pieces 10A, 10B, 11A, 11B have been shown vertical to the brick surfaces, they may be shaped to give flush-pointed, weather-struck or other forms of jointing. This shaping may be done by attaching removable fillets (not shown) to the side pieces.

Larger building blocks are often made with vertical apertures in the block. In order that mortar will not fall within these apertures, the tool described may be provided with blanking plates (not shown) within part 10 corresponding in shape and position to the apertures and attached to end piece 10C or side pieces 10A, 10B. The blanking plates will, of course, be made of the same thickness as pieces 10A, 10B, 10C so that mortar when smoothed over will remain over only the un-apertured face of the block.

As shown, flanges 13, 14 extend along only part of side pieces 10A, 10B. This enables the tool to be used at corners where the unflanged lengths of side pieces 10A, 10B may be placed crosswise on the end brick, with the flanges 13, 14 engaging the sides of a brick in the wall at right angles.

I claim:

1. A hand tool to aid in laying an upper course of bricks on a lower course of similar bricks, said hand tool comprising a frame and a handle connected to the frame, said frame including: a pair of similar L-shaped side members each having a long leg and a short leg and spaced laterally apart in lateral alignment with one another by a frame end member;

said long and short legs being provided with outer side flanges projecting laterally of said long and short legs respectively such that said long legs are adapted to be placed on a lower course of bricks with their respective side flanges overlaying side faces of that lower course whereby to define a gauge cavity to receive mortar on which a brick of an upper course is to be bedded and said short legs are adapted to engage an end face of an already laid immediately preceding brick of the upper course to define a gauge cavity to receive mortar which is to be sandwiched between the two said bricks of the upper course.

2. A hand tool as claimed in claim 1 wherein said frame end member interconnects the ends of the long legs remote from the short legs.

3. A hand tool as claimed in claim 1 wherein said frame end member interconnects the ends of the short legs remote from the long legs.

4. A hand tool as claimed in claim 1 wherein said handle is attached to said frame end member.

5. A hand tool as claimed in claim 1, wherein the outer side flanges on said long and short legs are contiguous at the junctions of the long and short legs.

6. A hand tool as claimed in claim 1, wherein the flanges of the long legs extend from the junction of the long legs with the short legs toward the ends of the long legs remote from the short legs but are spaced an appreciable distance therefrom.

7. A hand tool to aid in laying an upper course of bricks on a lower course of similar bricks, said tool comprising:

a frame including a pair of similar L-shaped side members each having a long leg and a short leg and spaced laterally apart in lateral alignment with one another, a first frame end member perpendicular to the long legs of the L-shaped side members and interconnecting the ends of those legs remote from the short legs, and a second frame end member perpendicular to the short legs of the L-shaped side members and interconnecting the ends of those legs remote from the long legs; and a handle attached to said second frame end member;

said long legs of the side members and said first frame end member constituting a first frame part of elongate U-shape;

said short legs of the side members and said second frame end member constituting a second frame part of U-shape perpendicular to the first frame part; and said long and short legs of the side members being provided with outer side flanges projecting laterally of the first and second frame parts respectively such that the first frame part is adapted to be placed on a lower course of bricks with the side flanges of said long legs of the side members overlaying side faces of that lower course whereby to define a gauge cavity to receive mortar on which a brick of an upper course is to be bedded and the second frame part is adapted to engage an end face of an already laid immediately preceding brick of the upper course to define a gauge cavity to receive mortar which is to be sandwiched between the two said bricks of the upper course.

8. A hand tool as claimed in claim 7, wherein the outer side flanges of said long and short legs of the L-shaped side members are contiguous at the junctions of the long and short legs.

9. A hand tool as claimed in claim 8, wherein the flanges of the long legs of the L-shaped side members extend from the junctions of those legs with the short legs toward the first frame end member but are spaced an appreciable distance therefrom.

* * * * *